US009358441B2

(12) United States Patent
Rea et al.

(10) Patent No.: US 9,358,441 B2
(45) Date of Patent: Jun. 7, 2016

(54) PORTABLE SPEED BAG RETENTION MECHANISM

(71) Applicants: Christopher Rea, Weehawkin, NJ (US); James Wickstead, Mendham, NJ (US); James Graham, Bedminster, NJ (US)

(72) Inventors: Christopher Rea, Weehawkin, NJ (US); James Wickstead, Mendham, NJ (US); James Graham, Bedminster, NJ (US)

( * ) Notice: Subject to any disclaimer, the term of this patent is extended or adjusted under 35 U.S.C. 154(b) by 0 days.

(21) Appl. No.: 14/556,076

(22) Filed: Nov. 28, 2014

(65) Prior Publication Data

US 2015/0165295 A1 Jun. 18, 2015

Related U.S. Application Data

(60) Provisional application No. 61/909,508, filed on Nov. 27, 2013.

(51) Int. Cl.
*A63B 69/20* (2006.01)

(52) U.S. Cl.
CPC ..... *A63B 69/205* (2013.01); *A63B 69/201* (2013.01); *A63B 2225/09* (2013.01)

(58) Field of Classification Search
CPC ..... A63B 21/1618–21/1636; A63B 69/20–69/206
See application file for complete search history.

(56) References Cited

U.S. PATENT DOCUMENTS

| | | | | |
|---|---|---|---|---|
| 923,928 | A * | 6/1909 | Armitage | A63B 69/205 482/87 |
| 8,663,073 | B1 * | 3/2014 | Hays | A63B 69/20 482/83 |
| 2012/0129658 | A1 * | 5/2012 | Hunt | A63B 1/00 482/38 |
| 2013/0023387 | A1 * | 1/2013 | Webb | A63B 21/1627 482/87 |
| 2014/0080682 | A1 * | 3/2014 | Moss | A63B 69/205 482/87 |
| 2014/0094350 | A1 * | 4/2014 | Sagall | A63B 69/201 482/89 |

* cited by examiner

*Primary Examiner* — Oren Ginsberg
*Assistant Examiner* — Jennifer M Deichl
(74) *Attorney, Agent, or Firm* — Thomas P. O'Connell; O'Connell Law Firm

(57) ABSTRACT

A portable exercise apparatus retention mechanism with a base platform, an exercise apparatus retainer, and at least one extendible and retractable retaining structure fixed to the base platform with first and second end portions for engaging first and second opposed surfaces when at least one of the end portions is extended. A sub-panel can be secured to the base structure with a central portion of the retaining structure disposed therebetween. The retention mechanism can retain an exercise apparatus, such as a speed bag. The end portions can have contoured flanges. A supplementary engaging mechanism with extended and retracted positions can project laterally from the base platform. The supplementary engaging mechanism could comprise first and second members pivotally coupled to the base platform.

21 Claims, 6 Drawing Sheets

PORTABLE SPEED BAG RETENTION MECHANISM

RELATED APPLICATION

This application claims priority to U.S. Provisional Patent Application No. 61/909,508, filed Nov. 27, 2013, the entirety of which being incorporated herein by reference.

FIELD OF THE INVENTION

The present invention relates generally to exercise equipment. More particularly, disclosed herein is a portable speed bag retention mechanism for selectively retaining a speed bag in relation to a building structure, such as in a door frame of a building structure, in a secure and stable disposition while remaining portable, easily installed without permanent fasteners, and readily removable. Embodiments of the invention are contemplated for additionally or alternatively retaining other exercise equipment, including but not limited to heavy punching bags, to permit alternative exercises.

BACKGROUND OF THE INVENTION

Speed bags are considered an effective way to build hand and eye coordination and stamina. Of course, the speed bag must be retained stably and securely. It has also been recognized that the location of the speed bag in relation to the user is critical to its effectiveness.

In a typical speed bag construction, the speed bag is mounted on a permanently installed frame attached to a building component, such as a ceiling or a wall. In other constructions, the speed bag is integrated into a freestanding exercise system. In some such systems, the speed bag is cantilevered from a stand-alone tower or pylon that is weighted to avoid or minimize unintentional movement of the overall system during use. Further structures have been disclosed where the speed bag is cantilevered over a doorway. Disadvantageously, none of these speed bag retention systems can reasonably be considered to be portable.

Numerous inventors have sought to provide improvements in the retention of speed bags. For a number of reasons, however, even the combined efforts of the inventors of the prior art have left a recognized need for a portable speed bag retention system that can selectively retain a speed bag in a reliable and stable manner.

For example, U.S. Pat. No. 7,214,169 discloses a punching bag structure that is mounted to the user's waist, cantilevering outward from the body. This design is limited in performance. For example, it is devoid of a speed bag mounting that permits the bag to hang vertically and then rebound after contact with a rebounding platform. Instead, the bag pivots and is returned to a centered position by a complicated linkage.

U.S. Pat. No. 6,623,408 discloses a speed bag support apparatus that mounts permanently to a wall. Turning a crank rotates the speed bag platform 90° about a pivot to become parallel to the mounting wall. While the speed bag platform can be rotated out of the way, it is not portable nor does it offer height adjustment, which is critical.

U.S. Pat. No. 7,044,895 describes a combination speed bag and striking device that incorporates a central frame and assembly that mounts or rests on a floor. A speed bag assembly cantilevers from its top. A striking apparatus projects centrally from the device for use in combination with the speed bag. While the speed bag and the striking device can be can be vertically adjusted individually, the device is not portable.

U.S. Pat. No. 5,944,639 is directed to a quick change, adjustable height speed bag. In this design, a mounting frame, which is permanently mounted to a wall, retains a movable speed bag framework. The speed bag frame can be adjusted vertically by use of counterweights located in vertical rails of the mounting frame. Like many devices of this type, the product is large, bulky and designed for permanent installation.

U.S. Pat. No. 5,554,088 discloses a sport training bag and a support with a central pole mounted on three legs. The central pole can telescope and supports a horizontal arm that holds a "C" shaped arm. A striking bag is retained by the ends of the arm. Unfortunately, the system is simultaneously bulky and not fixed against inadvertent movement.

U.S. Pat. No. 8,029,422 teaches a martial arts striking device with a ceiling-mounted central post and a series of radiating arms originating from the post. Each arm terminates in a cross bar from which a target object, such as a panel of flexible material, is suspended. This system, while perhaps unique in its performance capabilities, is complicated and bulky in structure and is not easily portable.

In view of the state of the art as summarized above, it will be appreciated that there remains a need for a mechanism for retaining a punching bag, such as a speed bag, in a stable and secure manner in relation to a building structure that is nonetheless readily portable.

SUMMARY OF THE INVENTION

With an awareness of the state of the art as summarized above, the present inventor set forth with the fundamental object of providing a portable mechanism for selectively retaining a punching bag in a stable and secure manner relative to a building structure.

A related object of the invention is to provide a portable mechanism for retaining a punching bag, such as a speed bag, that can adapt to a variety of locations.

Another object of the invention is to provide a portable mechanism for retaining a punching bag securely and stably without a need for mechanical fasteners or other permanent attachment means.

Still another object of the invention is to provide a mechanism for retaining a punching bag that can be conveniently installed, removed, broken down to lightweight and portable components, and transported.

These and further objects and advantages of the present invention will become obvious not only to one who reviews the present specification and drawings but also to those who have an opportunity to experience an embodiment of the punching bag retention mechanism disclosed herein in use. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth one or more of the foregoing objects, one embodiment of the invention comprises a portable retention mechanism for retaining an exercise apparatus in relation to a structure with first and second opposed support surfaces. The portable retention mechanism can be considered to be founded on a base platform. An exercise apparatus retainer, such as a pivotally retained hook, is coupled to the base platform for retaining an exercise apparatus relative to the base platform, and at least one extendible and retractable retaining structure is fixed to the base platform. The at least one retaining structure has a first end portion for engaging the first opposed support surface and a second end portion for engaging the second opposed support surface. At least one of the first and second end portions is extendable to induce a retaining engagement between the first and second end portions and the first and second opposed support surfaces, and the at least one of the first and second end portions is retractable to permit disengagement of the first and second end portions from the first and second opposed support surfaces.

In certain embodiments, both the first end portion and the second end portion of the at least one extendable and retractable retaining structure can be individually extendable and retractable. Under such a construction, the at least one extendable and retractable retaining structure could comprise an elongate structure with a central portion and the first and second end portions. Moreover, the first and second end portions could be extendable and retractable relative to the central portion of the at least one extendable and retractable retaining structure, such as by a threaded engagement, by pneumatics or hydraulics, by gearing, or by any other method or combination thereof.

A sub-panel could be secured to the base platform, and the sub-panel and the base platform could cooperate to present a substantially flat and continuous surface. In such embodiments, the central portion of the at least one extendable and retractable retaining structure could then be retained between the base platform and the sub-panel. In one particular example, the base platform can have a semi-tubular channel therein, and the central portion of the at least one extendable and retractable retaining structure could disposed in the semi-tubular channel. The sub-platform can then close the channel around the central portion of the at least one extendable and retractable retaining structure.

A retaining member, such as a rigid plate of metal or another material, could be fixed to the central portion of the at least one extendable and retractable retaining structure for preventing relative longitudinal and rotational movement of the at least one extendable and retractable retaining structure relative to the base platform. The retaining member can project laterally from the central portion of the at least one extendable and retractable retaining structure, and the retaining member can also be retained between the base platform and the sub-panel.

When the portable retention mechanism is prepared for use, an exercise apparatus will be retained by the exercise apparatus retainer. The exercise apparatus could, for example, be a punching bag, such as a speed bag. The base platform can include a substantially flat surface adjacent to the exercise apparatus retainer. Where a sub-panel is secured to the base platform, the sub-panel and the base platform can cooperate to present a substantially flat and continuous surface adjacent to the exercise apparatus retainer.

It is further contemplated that each of the first and second end portions of the at least one retaining structure can have a contoured flange to engage the first and second opposed surfaces in a positive engagement. For example, where the flange is designed to engage a door frame with a door stop, the flange can include a U-shaped distal surface.

The portable retention mechanism could further include a supplementary engaging mechanism coupled to the base platform that additionally engages a secondary external support surface. For example, the supplementary engaging mechanism can extend laterally in relation to a longitudinal established between the first and second end portions of the at least one extendable and retractable retaining structure. The secondary engaging mechanism could, for example, be constructed to achieve a positive engagement with a header of a door frame structure. As such, it could include a contoured distal end portion, which could include a notch for engaging the door stop of the door frame structure.

The supplementary engaging mechanism could have a retracted position and an extended position for engaging the secondary external support surface. One such possibility would be for the supplementary engaging mechanism to have at least one member pivotally coupled to the base platform so that the at least one member can be pivoted between extended and retracted positions. It is even further disclosed that the supplementary engaging mechanism can have first and second members disposed in general opposition that are selectively or automatically pivotable between extended and retracted positions.

Embodiments are possible where there are first and second extendible and retractable retaining structures fixed to the base platform. Each extendible and retractable retaining structure can have a first end portion for engaging the first opposed support surface and a second end portion for engaging the second opposed support surface. At least one of the first and second end portions of each of the extendible and retractable retaining structures is extendable to induce a retaining engagement with the first and second opposed support surfaces, and the at least one of the first and second end portions of each of the extendible and retractable retaining structures is retractable to permit disengagement from the first and second opposed support surfaces. A longitudinal is established between the first and second end portions each extendable and retractable retaining structure, and the longitudinals of the first and second extendable and retractable retaining structures are generally parallel.

One will appreciate that the foregoing discussion broadly outlines the more important goals and features of the invention to enable a better understanding of the detailed description that follows and to instill a better appreciation of the inventors' contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The portable speed bag retention mechanism disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
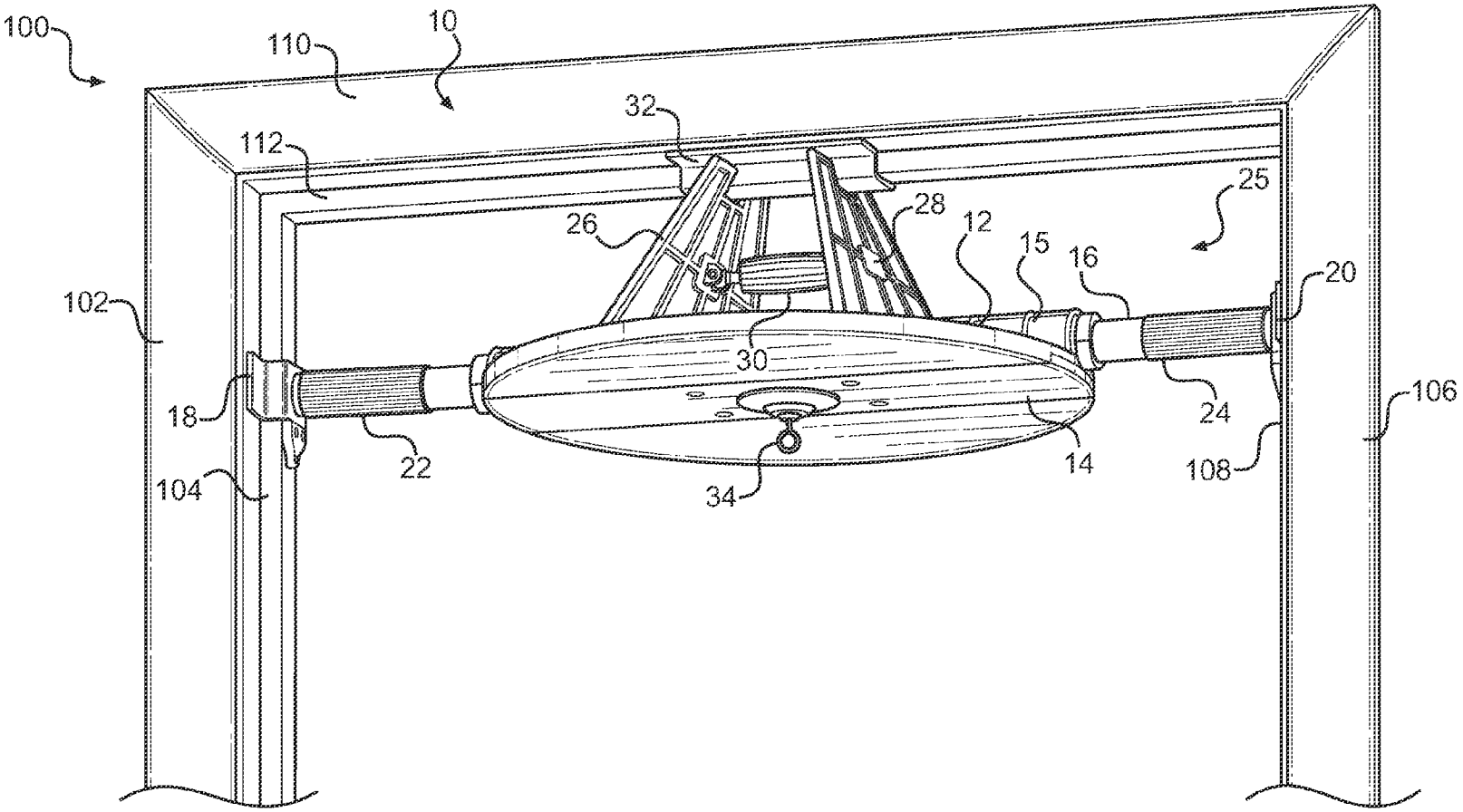
FIG. 1 is a lower perspective view of a portable speed bag retention mechanism according to the invention installed relative to a door frame.
Figure 2:
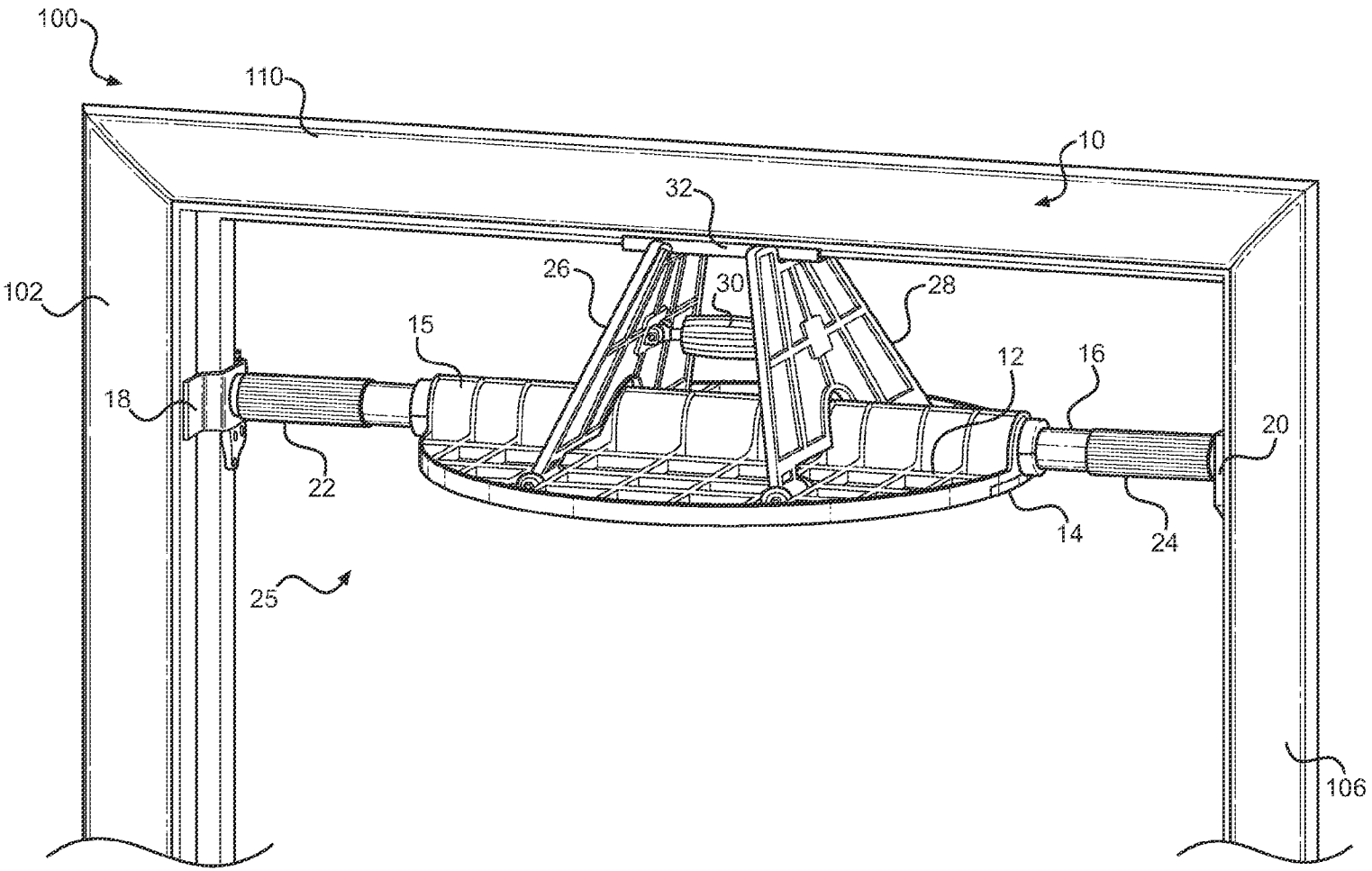
FIG. 2 is an upper perspective view of the portable speed bag retention mechanism of FIG. 1 again installed relative to a door frame.

Turning more particularly to the drawings, a portable speed bag retention mechanism according to the present invention is indicated generally at 10 in FIGS. 1 through 5. The portable speed bag retention mechanism 10 selectively retains a speed bag, such as that indicated at 42 in FIG. 5, in relation to a portion of a building structure, such as in the door frame 100 of a building structure as shown in FIGS. 1 and 2. By use of the retention mechanism 10, the speed bag 42, or potentially another exercise apparatus, can be retained in a secure and stable disposition, including during the vigorous activity of speed bag exercise. As taught herein, the retention mechanism 10 can be retained by a combination of frictional and, potentially, mechanical engagement with the door frame 100 or other structure without a need for permanent fasteners. As a consequence, the retention mechanism 10 is portable, easily installed, and readily removable.

Figure 3:
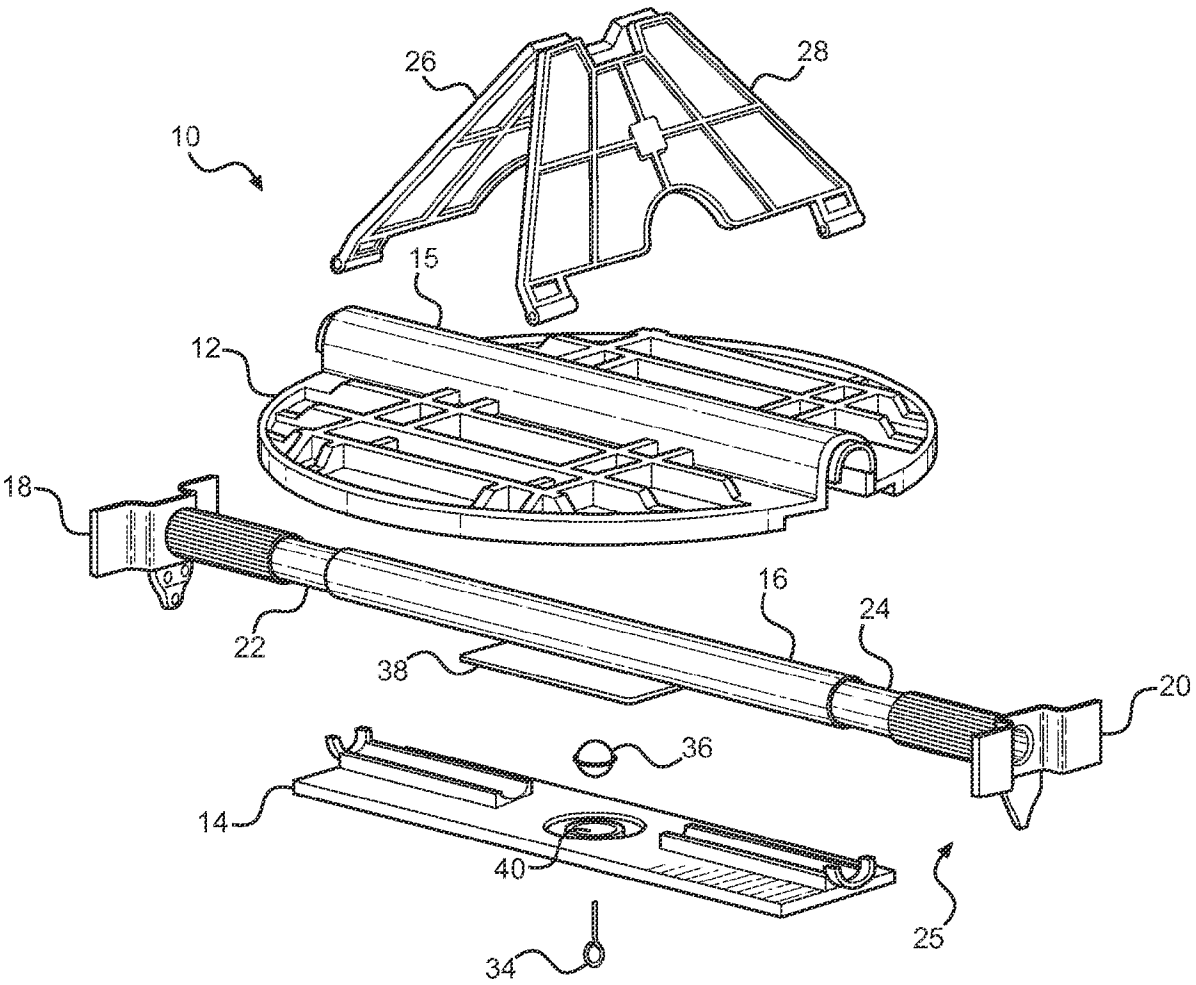
FIG. 3 is an exploded perspective view of a portable speed bag retention mechanism according to the invention.
Figure 4:
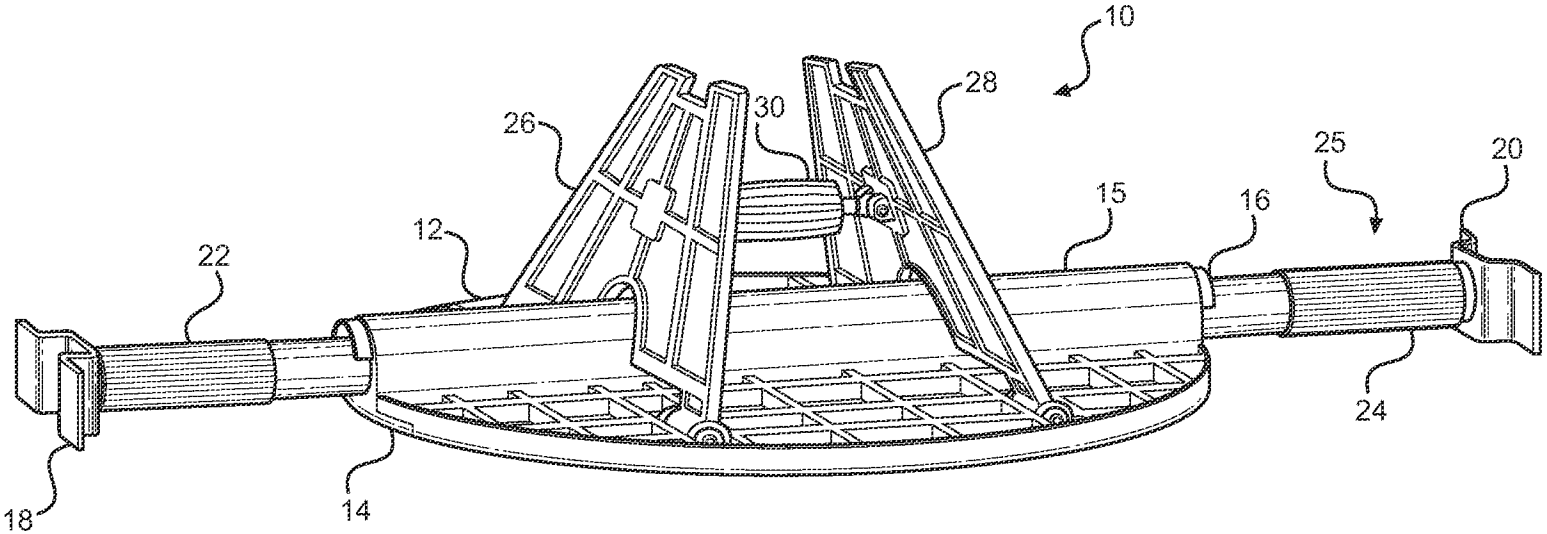
FIG. 4 is an upper perspective view of a portable speed bag retention mechanism as disclosed herein.
Figure 5:
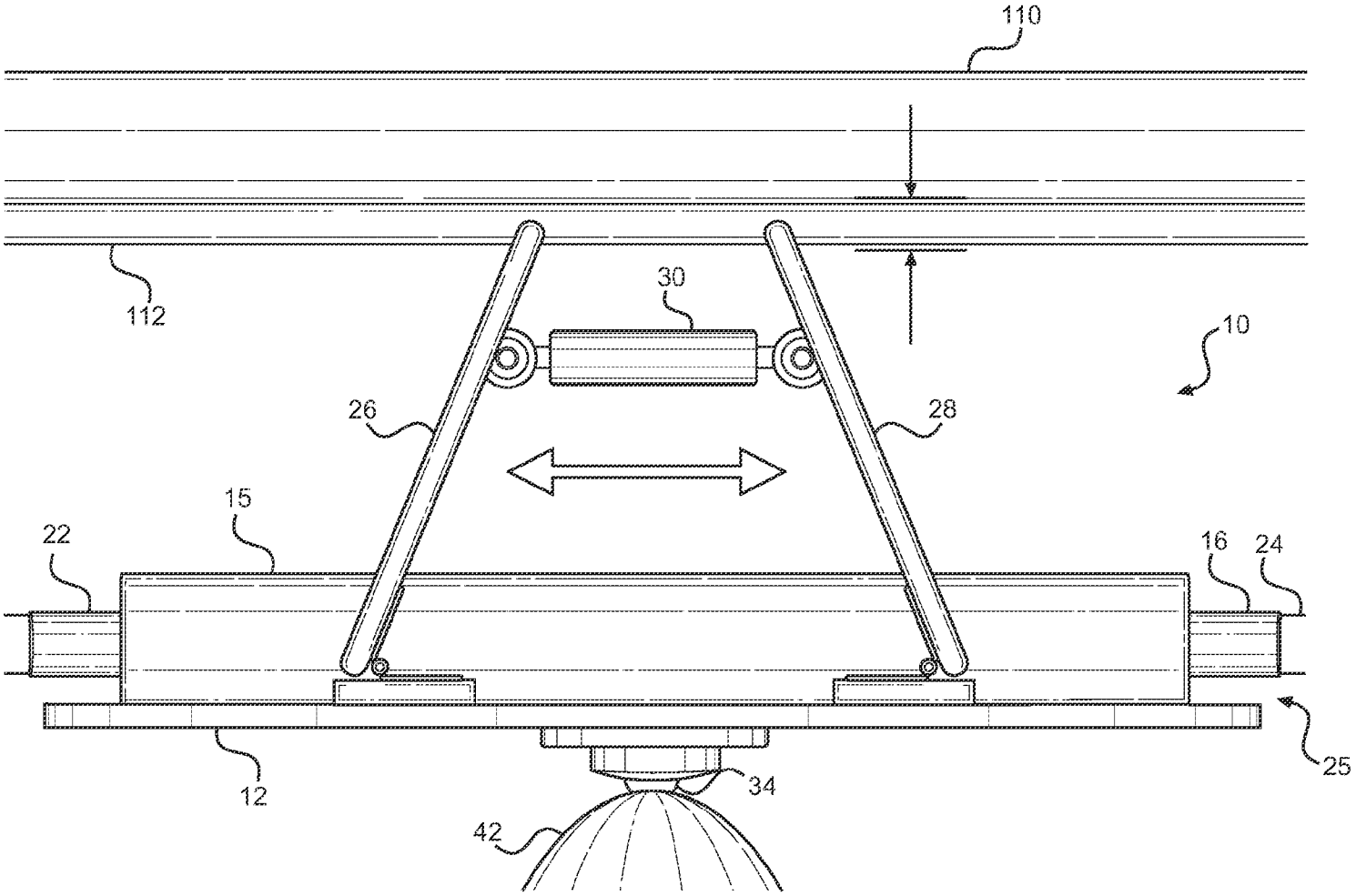
FIG. 5 is a view in front elevation of a header retaining portion of a portable speed bag retention mechanism pursuant to the invention installed relative to a door frame.

The speed bag retention mechanism 10 can be considered to be founded on a base platform 12 with an upper surface and a lower surface. A hook 34 or other retaining mechanism for supporting a speed bag 42 is centrally disposed projecting from the lower surface of the base platform 12. In the present embodiment, the hook 34 is pivotally retained, such as by a threaded or other engagement between a bolt portion of the hook 34 and a retaining ball 36 as depicted in FIG. 3. The retaining ball 36 is pivotally retained in relation to a sub-panel 14 of the base platform 12, and the bolt portion of the hook 34 passes through an aperture 40 in the sub-panel 14.

When assembled, the base platform 12 and the sub-panel 14 cooperate to establish a substantially flat and continuous lower surface to ensure consistent and reliable rebounding of the speed bag 42. The base platform 12 and the sub-panel 14 in this example provide a round lower surface, but such need not necessarily be the case. The base platform 12 and the sub-panel 14 could be secured together in any effective manner, including by a snap-fit engagement, mechanical fasteners, adhesive, some other coupling, or some combination or modification thereof.

An extendible retaining rod 25 is fixed in relation to the base platform 12 for selectively establishing a frictional retention of the retention mechanism 10 in relation to opposed support surfaces, such as the opposed jambs 102 and 106 of a door frame 100. The retaining rod 25 could be secured in relation to the base platform 12 in numerous different ways, each within the scope of the invention except as it might be expressly limited by the claims. In this example, the base platform 12 has a diametrical semi-tubular channel 15 formed therein, and the sub-platform 14 is fastened to close the channel 15 to secure the retaining rod 25 therein. Although not shown in FIGS. 1 through 5, it would be possible for a second and perhaps even further retaining rods to be provided.

A restraining mechanism can be provided for preventing relative longitudinal and rotational movement of the retaining rod 25 relative to the base platform 12. While it will be understood that the possibilities are numerous, the restraining mechanism in the depicted embodiment of FIG. 3 comprises a plate 38 fixed to the retaining rod 25 to project outboard thereof. The plate 38 could be fixed in place in any effective manner, such as but not limited to welding, integral formation, mechanical fasteners, any combination thereof, or any other suitable mechanism or mechanisms. The plate 38 is sandwiched between the base platform 12 and the sub-platform 14 thereby to prevent dislocation and rotation of the retaining rod 25 relative to the base platform 12 and the sub-platform 14.

The rod 25 or portions thereof can be rendered extendible and retractable in any effective manner. Each such mechanism is within the scope of the invention except as the claims may otherwise require. The rod 25 could be selectively actuated, such as by a threaded rod engagement, or the rod 25 could be automatically extended, such as by a pneumatic or hydraulic cylinder arrangement. In the depicted construction, the rod 25 is formed by a central, outer tube 16, a first inner tube 22 telescopingly engaged with a first end of the outer tube 16, and a second inner tube 24 telescopingly engaged with a second end of the outer tube 16. The telescoping engagement of the first and second inner tubes 22 and 24 with the outer tube 16 could, for example, be achieved by a threaded rod centrally retained by the outer tube 16 in combination with threaded end caps in the proximal ends of the first and second inner tubes 22 and 24. With that, a rotation of an inner tube 22 or 24 in relation to the outer tube 16 will produce an extension or retraction of the respective tube 22 or 24 thereby to permit a selective engagement or disengagement in relation to opposes support surfaces. When either or both inner tubes 22 or 24 are sufficiently extended, a frictional, retaining engagement will be effected between the retention mechanism 10 and the door structure 100 or any other structure providing opposed surfaces.

The extendable and retractable tube 22 has a contoured flange 18 at the distal end thereof, and the extendable and retractable tube 24 has a contoured flange 20 at the distal end thereof. The flanges 18 and 20 are contoured to engage the jambs 102 and 106 in a positive relationship. More particularly, in this embodiment, each flange 18 and 20 has a U-shaped profile whereby the door stop 104 of the jamb 102 can be received in the U-shape of the flange 18 and the door stop 108 of the jamb 106 can be received in the U-shape of the flange 20. The flanges 18 and 20 can be rotatable about a longitudinal axis of the tubes 22 and 24 to permit a rotation of the tubes 22 and 24 while the flanges 18 and 20 are engaged with the jambs 102 and 106. Further, each flange 18 and 20 can have a frictional surface, such as a non-slip, possibly rubber, cushion, affixed thereto or integrated therein.

As best seen in FIG. 3, the flanges 18 and 20 can have a stop or flange extension located under them that can be separately attached to door jambs 102 and 106 thereby to further restrain the flanges 18 and 20 and the retention mechanism 10 in general. While not required, it may additionally be possible for mechanical fasteners to be passed through the flange extensions or the flanges 18 and 20 and into the external support surface. With that, unintended displacement of the flanges 18 and 20 and the retention mechanism 10 in general would be further prevented.

The retention mechanism 10 can additionally be restrained be a supplementary engaging mechanism that additionally engages a secondary external support surface, in this example the header 110 of the door structure 100. That supplementary engaging mechanism can automatically engage the header 110, or it can selectively and, potentially, adjustably engage the header 110. In the present embodiment, the supplementary engaging mechanism has a proximal portion connected, whether directly or indirectly, to the base platform 12 and a distal portion that selectively engages the header 110. When engaged with the header 110, the supplementary engaging mechanism further prevents undesirable displacement of the retention mechanism 10, including by preventing rotation and by limiting its vertical movement in relation to the door structure 100. A plurality of alternative supplementary engaging mechanisms would be rendered obvious by the present disclosure. Each is within the scope of the invention except as it might be expressly limited by the claims.

In the embodiment of FIGS. 1 through 5, the supplementary engaging mechanism comprises first and second members 26 and 28 disposed in general opposition. The members 26 and 28 are pivotally coupled to the base platform 12. While the configurations of the first and second members 26 and 28 can vary within the scope of the invention, the depicted first and second members 26 and 28 approximate "A" shapes. Each member 26 and 28 has a proximal inlet for accommodating the semi-tubular channel 15 of the base platform 12 and a distal notch or other contouring for accommodating and mechanically engaging the door stop 112 of the header 110. As shown in FIGS. 1 and 2, an engaging flange 32, which can be contoured to engage the header 110 of the door frame 100, can be interposed between the distal ends of the first and second members 26 and 28 and the header 110. Frictional material can be applied to or retained by the engaging flange 32 for ensuring a secure engagement between the flange 32 and the header 110.

The first and second members 26 and 28 can thus be pivoted between a collapsed or retracted configuration where the members 26 and 28 are in proximity to one another and to the base platform 12 and an extended configuration where the members 26 and 28 are pivoted away from one another and toward or to an upright orientation. The pivoting of the member or members 26 and 28 could be selectively or automatically induced by any effective mechanism. In the illustrated embodiment, the first and second members 26 and 28 can be pressed toward upright configurations by a telescoping rod 30. The telescoping rod 30 could be selectively actuated, such as by a threaded rod engagement. Alternatively, the telescoping rod 30 could be automatically extended, such as by a pneumatic or hydraulic cylinder construction.

Figure 6:
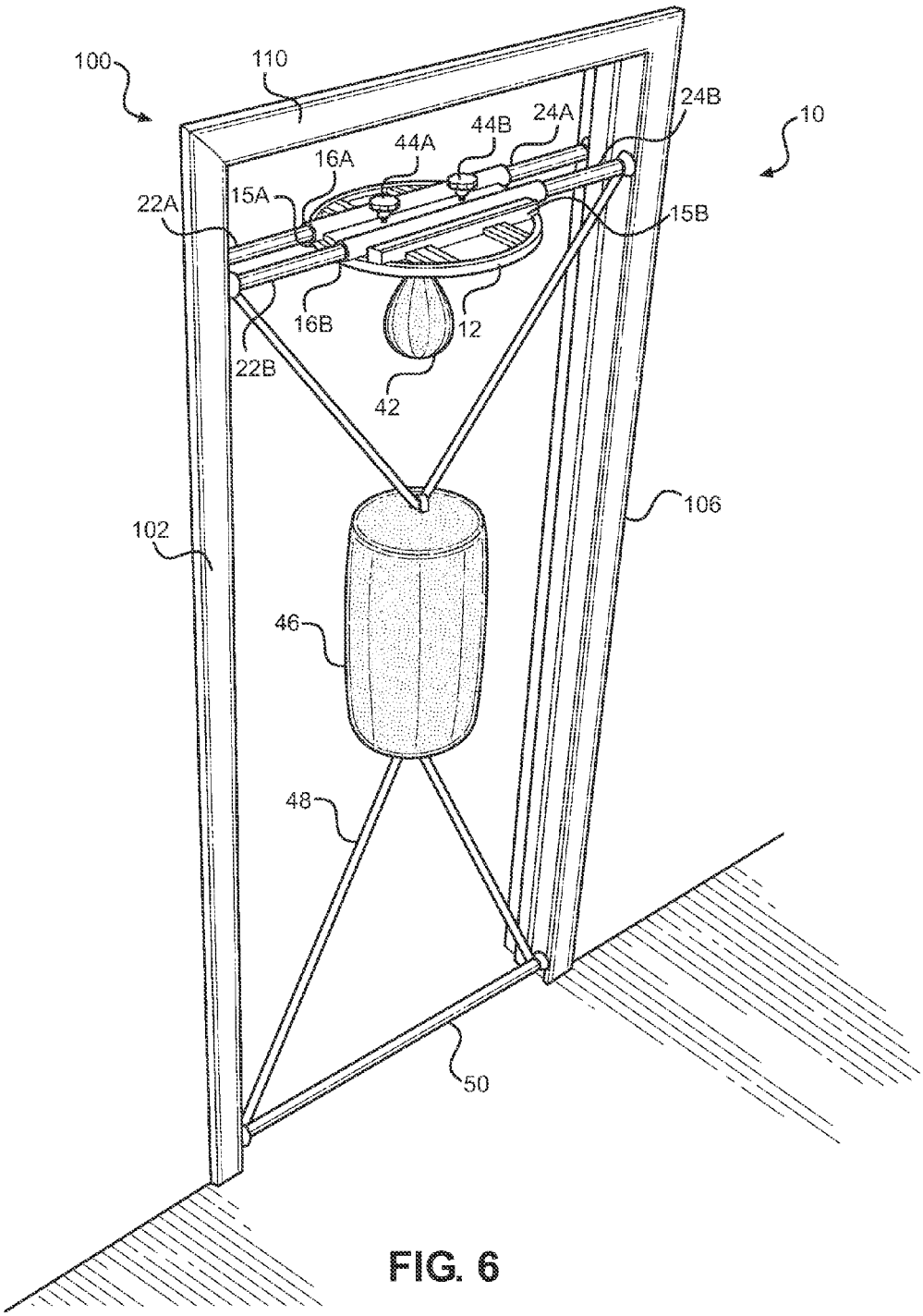
FIG. 6 is a perspective view of an alternative retention mechanism according to the invention installed relative to a door frame retaining a speed bag and a heavy bag.

It will be appreciated that numerous alternative embodiments of the retention mechanism 10 are possible, each being within the scope of the invention except as it may be expressly limited by the claims. One alternative retention mechanism is shown in FIG. 6 where the retention mechanism is again indicated at 10. Here, however, the retention mechanism 10 retains not only a speed bag 42 but also a heavier, body bag 46 in relation to a building structure. The building structure again comprises opposed jambs 102 and 106 of a door frame 100, but the invention need not be so limited.

The speed bag retention mechanism 10 is again founded on a base platform 12 with an upper surface and a lower surface. A hook (not shown) or other mechanism for supporting a speed bag 42 is centrally disposed projecting from the lower surface of the base platform 12. The base platform 12, which may or may not include a sub-panel 14, establishes a substantially flat, continuous, and round lower surface to ensure consistent and reliable rebounding of the speed bag 42.

Rather than just a single rod 25, first and second extendible retaining rods 25A and 25B are fixed in parallel in relation to the base platform 12 for selectively establishing a frictional retention of the retention mechanism 10 in relation to opposed jambs 102 and 106 of a door frame 100 or other opposed surfaces. Again, the retaining rods 25A and 25B can be secured to the base platform 12 in numerous ways. In this embodiment, the securing of the retaining rods 25A and 25B to the base platform 12 is achieved by semi-tubular channels 15A and 15B formed with the base platform 12. The rods 25A and 25B can be rendered extendible and retractable in any effective manner. In this illustrated embodiment, the rods 25A and 25B can be extended and retracted by control knobs 44A and 44B that actuate an extension and refraction mechanism, such as rack and pinion gearing or other gearing, pneumatics, hydraulics, or any other mechanism or combination thereof. The rods 25A and 25B can have members formed with or affixed to the ends thereof with frictional material for spreading the force applied by the rods 25A and 25B and for additionally preventing inadvertent displacement.

Although depicted only in relation to the embodiment of FIGS. 1 through 5, the retention mechanism 10 of FIG. 6 can if necessary or desirable additionally be restrained be a supplementary engaging mechanism that contacts the header 110 of the door structure 100. However, in view of the stability provided by the first and second rods 25A and 25B and the supported heavy bag 46, the supplemental restraint provided by a header engaging mechanism may be unnecessary.

In any case, the heavy bag 46 can be retained for interaction with a user by, for example, upper resilient bands 48 spanning from the upper end of the heavy bag 46 to distal portions of one or both rods 25A and 25B and lower resilient bands 48 spanning from the lower end of the heavy bag 46 to distal ends of a lower retaining rod 50. The lower retaining rod 50 can be extendable and retractable in and out of frictional, retaining engagement with opposed surfaces of a building structure, such as the opposed jambs 102 and 106 of a door structure 100. The extension and retraction of the lower retaining rod 50 again can be induced selectively, such as by a threaded arrangement, by pneumatics or hydraulics, or by any other effective means. Alternatively, the lower retaining rod 50 could be automatically extended, such as by a spring-loaded construction or any other effective means.

When the retention mechanism 10 of FIG. 6 is installed relative to a building structure, therefore, a user can exercise using a speed bag 42, a heavy bag 46, or a combination thereof. As with the embodiment of FIGS. 1 through 5, the retention mechanism 10 can be installed without a need for permanent fasteners to retain the speed bag 42 and the heavy bag 46 securely and stably. Moreover, the retention mechanism 10 can be readily removed for transport and storage.

With certain details and embodiments of the present invention for a portable speed bag retention mechanism 10 disclosed, it will be appreciated by one skilled in the art that numerous changes and additions could be made thereto without deviating from the spirit or scope of the invention. This is particularly true when one bears in mind that the presently preferred embodiments merely exemplify the broader invention revealed herein. Accordingly, it will be clear that those with major features of the invention in mind could craft embodiments that incorporate those major features while not incorporating all of the features included in the preferred embodiments.

Therefore, the following claims shall define the scope of protection to be afforded to the inventors. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, any such claims shall be construed to cover not only the corresponding structure and material expressly described in this specification but also all equivalents thereof.

We claim as deserving the protection of Letters Patent:

1. A portable retention mechanism for retaining an exercise apparatus in relation to a structure with first and second opposed support surfaces, the portable retention mechanism comprising:

a base platform;

an exercise apparatus retainer coupled to the base platform for retaining an exercise apparatus relative to the base platform;

at least one extendible and retractable retaining structure coupled to the base platform wherein the at least one retaining structure has a first end portion for engaging the first opposed support surface and a second end portion for engaging the second opposed support surface and wherein at least one of the first and second end portions is extendable to induce a retaining engagement between the first and second end portions and the first and second opposed support surfaces and wherein the at least one of the first and second end portions is retractable to permit disengagement of the first and second end portions from the first and second opposed support surfaces; and a supplementary engaging mechanism coupled to the base platform that additionally engages a secondary external support surface wherein a longitudinal is established between the first and second end portions of the at least one extendable and retractable retaining structure, wherein the supplementary engaging mechanism extends laterally to the longitudinal between the first and second end portions of the at least one extendable and retractable retaining structure, wherein the supplementary engaging mechanism has a retracted position and an extended position for engaging the secondary external support surface, wherein the supplementary engaging mechanism comprises at least one member pivotally coupled to the base platform to pivot about an axis substantially perpendicular to the longitudinal between the first and second end portions of the at least one extendable and retractable retaining structure whereby the at least one member can be pivoted between extended and retracted positions.

2. The portable retention mechanism of claim 1 wherein both the first end portion and the second end portion of the at least one extendable and retractable retaining structure are extendable and retractable.

3. The portable retention mechanism of claim 2 wherein the at least one extendable and retractable retaining structure comprises an elongate structure with a central portion and the first and second end portions and wherein the first and second end portions are extendable and retractable relative to the central portion of the at least one extendable and retractable retaining structure.

4. The portable retention mechanism of claim 1 further comprising an exercise apparatus retained by the exercise apparatus retainer.

5. The portable retention mechanism of claim 4 wherein the exercise apparatus comprises a punching bag.

6. The portable retention mechanism of claim 1 wherein the base platform has a substantially flat surface adjacent to the exercise apparatus retainer.

7. The portable retention mechanism of claim 6 further comprising a sub-panel secured to the base platform wherein the sub-panel and the base platform cooperate to present a substantially flat and continuous surface adjacent to the exercise apparatus retainer.

8. The portable retention mechanism of claim 1 wherein each of the first and second end portions of the at least one retaining structure has a contoured flange with a contoured distal surface to engage the first and second opposed surfaces in a positive engagement.

9. The portable retention mechanism of claim 1 wherein the supplementary engaging mechanism has a contoured distal end portion for positively engaging the secondary external support surface.

10. The portable retention mechanism of claim 9 wherein the contoured distal end portion of the supplementary engaging mechanism includes an open notch configured to receive a portion of the secondary external support surface.

11. The portable retention mechanism of claim 1 wherein the supplementary engaging mechanism comprises first and second members disposed in general opposition, wherein the first member is pivotable about a first axis that is substantially perpendicular to the longitudinal between the first and second end portions of the at least one extendable and retractable retaining structure, wherein the second member is pivotable about a second axis that is substantially perpendicular to the longitudinal between the first and second end portions of the at least one extendable and retractable retaining structure, and wherein the first pivot axis and the second pivot axis are generally parallel and are spaced along the longitudinal between the first and second end portions of the at least one extendable and retractable retaining structure.

12. The portable retention mechanism of claim 1 wherein there are first and second extendible and retractable retaining structures fixed to the base platform, wherein each extendible and retractable retaining structure has a first end portion for engaging the first opposed support surface and a second end portion for engaging the second opposed support surface, wherein at least one of the first and second end portions of each of the extendible and retractable retaining structures is extendable to induce a retaining engagement with the first and second opposed support surfaces and wherein the at least one of the first and second end portions of each of the extendible and retractable retaining structures is retractable to permit disengagement from the first and second opposed support surfaces, wherein a longitudinal is established between the first and second end portions each extendable and retractable retaining structure, and wherein the longitudinals of the first and second extendable and retractable retaining structures are generally parallel.

13. The portable retention mechanism of claim 11 further comprising an extendible mechanism coupled to at least one of the first and second members wherein the extendible mechanism is operative to actuate the at least one of the first and second members toward an extended position.

14. The portable retention mechanism of claim 13 wherein the extendible mechanism has a first end coupled to the first member and a second end coupled to the second member and wherein the extendible mechanism is operative to actuate the first and second members toward extended positions.

15. The portable retention mechanism of claim 13 wherein the extendible mechanism comprises a telescoping rod.

16. The portable retention mechanism of claim 1 further comprising an extendible mechanism coupled to the at least one member of the supplementary engaging mechanism wherein the extendible mechanism is operable to actuate the at least one member toward an extended position.

17. A portable retention mechanism for retaining an exercise apparatus in relation to a structure with first and second opposed support surfaces, the portable retention mechanism comprising:

a base platform;

an exercise apparatus retainer coupled to the base platform for retaining an exercise apparatus relative to the base platform;

at least one extendible and retractable retaining structure coupled to the base platform wherein the at least one retaining structure comprises an elongate structure with a central portion, a first end portion for engaging the first opposed support surface, and a second end portion for engaging the second opposed support surface and wherein the first and second end portions are extendable to induce a retaining engagement between the first and second end portions and the first and second opposed support surfaces and wherein the first and second end portions are retractable to permit disengagement of the first and second end portions from the first and second opposed support surfaces; and a sub-panel secured to the base platform wherein the sub-panel and the base platform cooperate to present a substantially flat and continuous surface and wherein the central portion of the at least one extendable and retractable retaining structure is retained between the base platform and the sub-panel.

18. The portable retention mechanism of claim 17 wherein the base platform has a semi-tubular channel therein, wherein the central portion of the at least one extendable and retractable retaining structure is disposed in the semi-tubular channel, and wherein the sub-platform closes the channel around the central portion of the at least one extendable and retractable retaining structure.

19. The portable retention mechanism of claim 17 further comprising a retaining member fixed to the central portion of the at least one extendable and retractable retaining structure for preventing relative longitudinal and rotational movement of the at least one extendable and retractable retaining structure relative to the base platform, wherein the retaining member projects laterally from the central portion of the at least one extendable and retractable retaining structure, and wherein the retaining member is retained between the base platform and the sub-panel.

20. The portable retention mechanism of claim 17 further comprising a supplementary engaging mechanism coupled to the base platform that additionally engages a secondary external support surface wherein a longitudinal is established between the first and second end portions of the at least one extendable and retractable retaining structure and wherein the supplementary engaging mechanism extends laterally to the longitudinal between the first and second end portions of the at least one extendable and retractable retaining structure.

21. The portable retention mechanism of claim 20 wherein the supplementary engaging mechanism has a retracted position and an extended position for engaging the secondary external support surface wherein the supplementary engaging mechanism comprises at least one member pivotally coupled to the base platform to pivot about an axis substantially perpendicular to the longitudinal between the first and second end portions of the at least one extendable and retractable retaining structure whereby the at least one member can be pivoted between extended and retracted positions.

* * * * *